US007568515B2

(12) United States Patent
Yoshihara et al.

(10) Patent No.: US 7,568,515 B2
(45) Date of Patent: Aug. 4, 2009

(54) STRUCTURE OF CYLINDER BLOCK BEING CAST WITH CYLINDER LINER, METHOD OF MANUFACTURING CYLINDER BLOCK, AND CYLINDER LINER TO BE CAST IN THE METHOD OF MANUFACTURING CYLINDER BLOCK

(75) Inventors: Akira Yoshihara, Tokyo (JP); Atsushi Tamaru, Tokyo (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 182 days.

(21) Appl. No.: 11/324,337

(22) Filed: Jan. 4, 2006

(65) Prior Publication Data

US 2006/0108089 A1 May 25, 2006

Related U.S. Application Data

(63) Continuation of application No. PCT/JP2004/009987, filed on Jul. 7, 2004.

(30) Foreign Application Priority Data

Jul. 7, 2003 (JP) ..... 2003-193151

(51) Int. Cl.
*B22D 19/00* (2006.01)

(52) U.S. Cl. ..... 164/98; 164/112; 164/332

(58) Field of Classification Search ..... 164/98, 164/113, 332, 333, 344, 370, 137, 334, 112; 123/41.82 A, 41.74
See application file for complete search history.

(56) References Cited

U.S. PATENT DOCUMENTS 6,363,995 B1 * 4/2002 Baranzke ..... 164/100

FOREIGN PATENT DOCUMENTS

| | | | |
|---|---|---|---|
| JP | 58-137559 U | | 9/1983 |
| JP | 4-135052 A | | 5/1992 |
| JP | 04135052 | * | 5/1992 |
| JP | 2000-64902 A | | 3/2000 |

* cited by examiner

*Primary Examiner*—Kevin P Kems
(74) *Attorney, Agent, or Firm*—Birch, Stewart, Kolasch & Birch, LLP

(57) ABSTRACT

A cylinder block has a cast cylinder liner. A different level portion with a predetermined width is provided in a projected part formed along the lower end-face of the cylinder liner, in the centrifugal direction of the cylinder liner. In this case, the different level portion has a width corresponding to the dimensional tolerance range with respect to a finished inside diameter dimension position, and a outer circumference edge of the different level portion is provided in the outer circumference side farther than the finished inside diameter dimension position. Displacement of a hole is detected by checking the different level portion after machining the internal circumference of the cylinder liner.

2 Claims, 7 Drawing Sheets

STRUCTURE OF CYLINDER BLOCK BEING CAST WITH CYLINDER LINER, METHOD OF MANUFACTURING CYLINDER BLOCK, AND CYLINDER LINER TO BE CAST IN THE METHOD OF MANUFACTURING CYLINDER BLOCK

CROSS-REFERENCE TO RELATED APPLICATIONS

This is a Continuation Application of PCT Application No. PCT/JP2004/009987, filed Jul. 7, 2004, which was published under PCT Article 21(2) in Japanese.

This application is based upon and claims the benefit of priority from prior Japanese Patent Application No. 2003-193151, filed Jul. 7, 2003, the entire contents of which are incorporated herein by reference.

BACKGROUND OF THE INVENTION

1. Field of the Invention

The present invention relates to a cylinder block being cast with cylinder liner which is manufactured by casting a cylinder liner while covering the end-face, a method of manufacturing, and a casting cylinder liner used for the same method.

2. Description of the Related Art

A cylinder block of an engine has been formed by die casting using a light metal such as aluminum alloy. A cylinder block made of aluminum alloy has a defect in wear resistance. To overcome the defect, a cylinder liner is inserted into a cylinder requiring wear resistance. A cylinder liner having a cylindrical shape is made of cast iron, which is cast together with a cylinder block when it is formed by die-casting. For an example, there is a die-casting method disclosed in Jpn. Pat. Appln. KOKAI Publication No. 2000-64902.

In the disclosed method, as shown in FIG. 11 and FIG. 12, a cylinder block 2 made of aluminum alloy is cast so as to cover the whole cylinder liner 1 including the end-face 3 of a deck surface side by an aluminum alloy 4. This cylinder block called an overcasting type has been often used.

The cylinder block 2 of this type is usually cast by using molds 5*a* and 5*b* of a die-casting machine, to cover the end-face 3 of the cylinder head side by aluminum alloy 4, as shown in FIG. 13. After being cast, a half-finished cylinder block body 2*a* is machined to finish the cylinder diameter. The inside of the cylinder liner 1 is grinded by a hole machining tool 7 along the finished inside diameter dimension position α indicated by a chain line in FIG. 14, together with an upper side projected part 4*a* covering the cylinder head side end-face of the cylinder liner 1. For example, boring or honing is used for this machining. The cast cylinder block body 2*a* is performed a machining to finish the deck surface of the cylinder head. The deck surface is polished by a polishing tool 8 along the final deck surface position δ indicated by a chain line in FIG. 14. The cylinder block 2 is completed through these machining.

In the usual process of casting the cylinder liner 1, a shaft-shaped part 10 that projects downward from the upper mold 5*a* forming the deck surface side of the cylinder block 2 is inserted into the cylinder liner 1, as shown in FIG. 13. The end-face of the cylinder liner 1 opposite to the deck surface side is supported by a holder (not shown) that is formed in flat on the mold surface of the lower mold 5*b* forming the opposite side of the deck surface side. Thus, the cylinder liner 1 is held between the upper mold 5*a* and lower mold 5*b*.

If the position of the inside of the cylinder liner 1 is the same as the position of the end of the upper side projected part 4*a* covering that end-face, there is no place to hold the cylinder liner 1. Namely, if the whole cylinder liner is to be housed in the cavity formed by the upper mold 5*a* and lower mold 5*b*, the cylinder liner cannot be held at a desired position in the upper mold 5*a* and lower mold 5*b* for die-casting.

Thus, the inside surface of the cylinder liner 1 used for the overcasting-type cylinder block 2 has the wall thickness projecting to the inside diameter side from the end of the upper side projected part 4*a* covering the end-face 3 of the deck surface side of the cylinder liner 1, as shown in FIG. 14. By using this liner, the cylinder liner 1 is held between the upper mold 5*a* and lower mold 5*b*.

Concretely, as shown in FIG. 13 and FIG. 14, in the deck surface side of the cylinder liner l, the portion of the end-face 3 of the cylinder liner 1, which projects to the inside diameter side from the cavity part 12*a* forming the upper side projected part 4*a* is used as a mold contact part 13. In the whole cylinder liner 1, the mold contact part 13 is pressed by an annular holding part 14 formed thicker than the other parts at the base of the shaft-shaped part 10. As a result, the cylinder liner 1 is supported between the holding part 14 of the upper mold 5*a* and the holding part 11 of the lower mold 5*b*. Namely, the cylinder liner 1 held inside the upper mold 5*a* and lower mold 5*b*.

As a result of the hole machining, such as boring or honing in the cylinder liner 1, a hole may be bored at a position displaced from the finished inside diameter dimension position α which is designed. As long as this displacement (a manufacturing error) is within the machining tolerance for a finished product (the dimensional tolerance for a finished liner hole), a certain wall thickness of the cylinder liner 1 is ensured. Therefore, it is no problem to regard the cylinder block 2 as a product completed as designed.

The inside surface of the cylinder liner 1 is machined together with the upper side projected part 4*a* covering the end-face 3 by boring or honing, as shown in FIG. 14. Therefore, a machined liner hole 23 cannot be judged from the outside as to whether its position is displaced, even if the hole machining position is displaced.

There is a liner projected type cylinder block, in which a cylinder liner is cast by projecting from a cylinder block. In a cylinder liner used for this type, the inside surface is finished close to the dimension of finished inside diameter in the primary machining process. As the inside surface is formed close to the finished dimension before machining, this cylinder liner can be immediately judged or whether the machining quality is good or bad when displacement exceeding the tolerance range occurs.

In contrast, for the over-casting type cylinder liner 1, a primary machined product that is large in the finished inside diameter dimension α to the inside surface before machining is used to ensure the mold contact part 13. Since this type of cylinder liner 1 is large in the machining margin to the finished dimension, it is possible to complete the hole machining while a displacement exceeding the finished dimensional tolerance is being generated. Thus, the cylinder liner 1 having an extremely thin wall thickness portion may exit in the completed cylinder block 2.

BRIEF SUMMARY OF THE INVENTION

The present invention provides a structure of a cylinder block being cast a cylinder liner, which easily permits detection of displacement exceeding a machining tolerance of a cylinder liner hole without changing a method of manufacturing a cylinder block, a method of manufacturing the cylinder block, and a cylinder liner for casting with a simple structure suitable for detection of displacement.

A cylinder block structure according to the present invention has a cylinder liner. A projected part is formed along a lower end-face of the cylinder liner, and a different level portion that has a predetermined width in the centrifugal direction of the cylinder liner. In this case, the different level portion is formed to be like a circle concentric with the cylinder liner, or at several locations on a circumference of the cylinder liner.

Another cylinder block structure according to the present invention has a cylinder liner cast at a predetermined position of a cylinder block. A projected part is formed along a lower end-face of the cylinder liner. Before a process of machining the internal circumference of the cylinder liner being cast, the projected part has a different level portion having a predetermined width in the centrifugal direction of the cylinder liner. The outside diameter of the different level portion in the radial direction of the cylinder liner is set to the dimension equivalent to the sum of the casting tolerance allowing displacement generated when casing the cylinder liner and the machining tolerance for the machining process, with respect to the finished inside diameter dimension of the cylinder liner.

A method of manufacturing a cylinder block being cast cylinder liner according to the present invention forms a cylinder block by casting a cylindrical cylinder liner at a predetermined position. First, prepare a cylinder liner as a primary product having an annular different level portion with a boundary formed inward in the radial direction by a predetermined dimension, with respect to a finished dimension of an internal circumference of the cylinder liner. Then, set the cylinder liner as a primary product to a holding part that is provided in a mold to form the cylinder block and is fitted with the different level portion. In this state, cast the cylinder block by filling the mold with molten metal. Machine the internal circumference of the cylinder liner to the finished dimension. Detect at least one of a position of the cylinder liner relative to the cylinder block, a position of the cylinder liner hole relative to the cylinder liner, and a wall thickness of the cylinder liner in accordance with whether the different level part exists or not after machining.

A cylinder liner for being cast according to the present invention is cylindrical with an annular different level portion in the end-face. A boundary of the different level portion is formed inside in the radial direction from a machining dimensional tolerance allowed to the finished dimension of the internal circumference of the cylinder liner. The different level portion is provided in both end-faces of the cylinder liner, so that it is unnecessary to specify the direction of the cylinder liner when setting the cylinder liner in a mold.

A method of manufacturing a cylinder block having cylinder liner cast, according to the present invention uses a mold which holds a cylindrical cylinder liner to cast the cylinder liner at a predetermined position of a cylinder block. The mold forms a boundary of an annular different level portion having a width in a radial direction of the cylinder liner along the lower end-face of the cylinder liner by casting. The boundary of the different level portion is provided at a position where is outside of diameter equivalent to a sum of casting tolerance and machining tolerance, with respect to the finished dimension position of the cylinder liner internal circumference. The casting tolerance is the value to allow displacement generated when the cylinder block is cast with the cylinder liner in the mold. The machining tolerance is a tolerance for the finish machining of the internal circumference of the cylinder liner. The finishing of machining the internal circumference of the cylinder liner is operated, after a cylinder block is cast by filling the mold with molten metal. At least one of a displacement of the cylinder liner from the cylinder block, a displacement of a machining position of a hole of the cylinder liner, and a wall thickness of the cylinder liner is detected based on whether the different level portion exists or not.

DETAILED DESCRIPTION OF THE INVENTION

Figure 1:
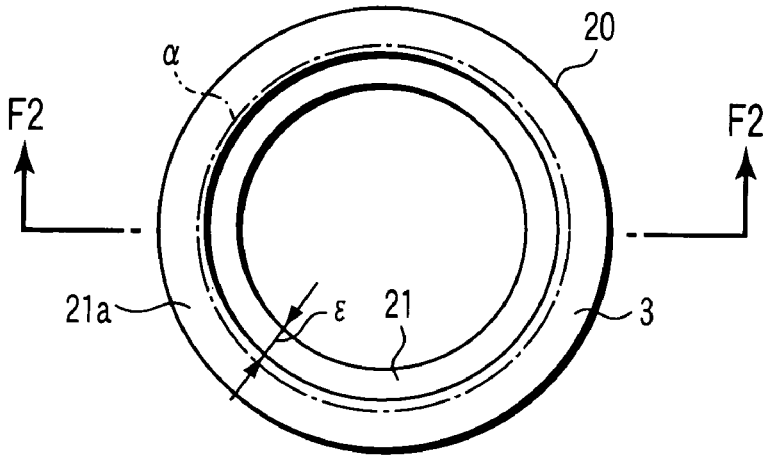
FIG. 1 is a plan view of a cylinder liner as a primary product used for a method of manufacturing an overcasting-type cylinder block according to a first embodiment of the present invention, as seen in the axial direction.
Figure 2:
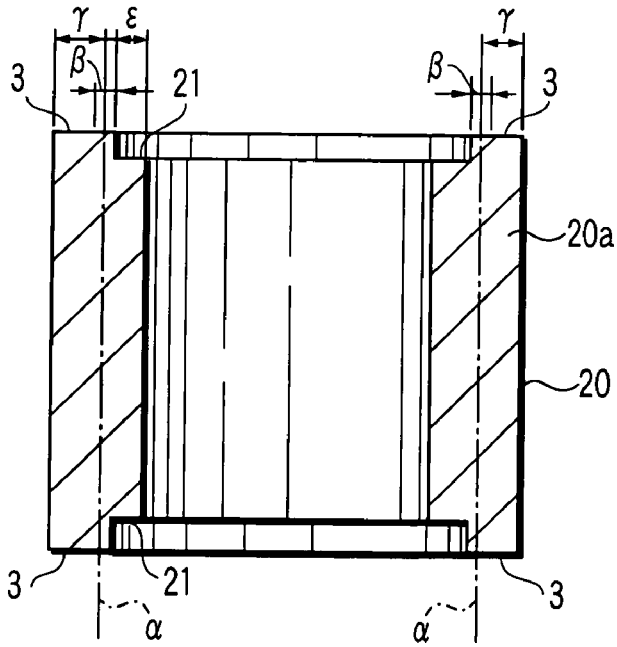
FIG. 2 is a sectional view of the cylinder liner taken along lines F2-F2 shown in FIG. 1.

A structure of a cylinder block according to a first embodiment of the present invention will be explained with reference to drawings FIGS. 1-6. In this embodiment, as shown in FIGS. 1 and 2, an overcasting-type cylinder block 2 is cast by casting a cylinder liner 20. The cylinder liner 20 is devised to be judged from the outside as to whether the quality of hole machining is good or bad. For the components having the same functions as those described in Background Art, the same reference numerals will be given and detailed description will be omitted.

The cylinder liner 20 has a liner body 20*a* formed cylindrical as a primary product cylinder liner, and a different level portion 21, for holding a mold, formed annular in both end-faces 3 of the liner body 20*a*. The cylinder liner 20 is made of a high hardness cast iron, for example. The different level portion 21 is formed in the end-face 3 toward the radial direction just like a step. The boundary 21*a* of the different level portion 21 is provided within the dimensional tolerance range β provided in the internal circumference side, with respect to the finished inside diameter dimension position α of the hole of the cylinder liner 20 indicated by a chain line in the drawing.

The dimensional tolerance range β includes the casting tolerance and machining tolerance. The casting tolerance is a value of displacement allowed when the cylinder liner 20 is cast in the cylinder block 2. The machining tolerance is a value allowed when the internal circumference of the cylinder liner 20 is machined for finishing.

The area located outside in the radial direction from the finished inside diameter dimension position α is a casting area γ that is buried by casting the cylinder block 2. The finished inside diameter dimension position α is provided at the middle in the continued dimensional tolerance range β and casting area γ. The holding part 14 of the upper mold 5*a* in the deck surface side and the holding part 11 of the lower mold 5*b* in the opposite side of the deck surface have a shape to fit each other corresponding to the shape of the different level portion 21. The different level portion 21 is a liner holding area ϵ that comes into contact with the holding parts 11 and 14, respectively.

Figure 3:
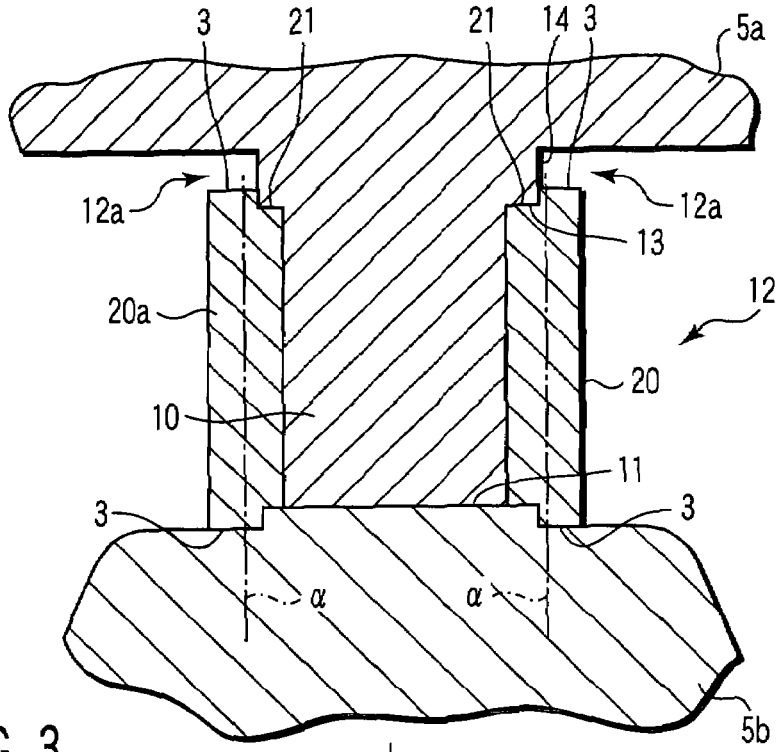
FIG. 3 is a sectional view of the cylinder liner shown in FIG. 2 in the state set in a mold.

Next, a method of manufacturing the cylinder block 2 will be explained. As shown in FIG. 3, the cylinder liner 20 is set between the upper mold 5*a* and lower mold 5*b* of a die-casting machine. The end-face 3 of the cylinder liner 20 in the opposite side to the deck surface is fit in the holding part 11 of the mold 5*b* by the different level portion 21. The shaft-shaped part 10 projecting from a lower end of the upper mold 5*a*, the lower surface side in the drawing, is inserted from the end-face 3 in the deck surface side of the cylinder liner 20. The holding part 14 at the base of the shaft-shaped part 10 is fitted inside the different level portion 21 provided in the end-face 3 in the deck surface side of the cylinder liner 20.

The upper mold 5*a* and lower mold 5*b* are tightened in the state holding the cylinder liner 20, as shown in FIG. 3. The cylinder liner 20 is held between the upper mold 5*a* and lower mold 5*b*, so that the outer circumference is surrounded by a cavity 12. A cavity part 12*a* is formed in the upper part of the casting area γ in the deck surface side of the cylinder liner 20. The cavity 12 and cavity part 12*a* are filled with molten aluminum alloy 4. As a result, the cylinder block 2 is cast as one unit with the cylinder liner 20 (die-cast molding). Instead of the aluminum alloy, another molten metal such as a light metal other than aluminum alloy may be used.

Figure 4:
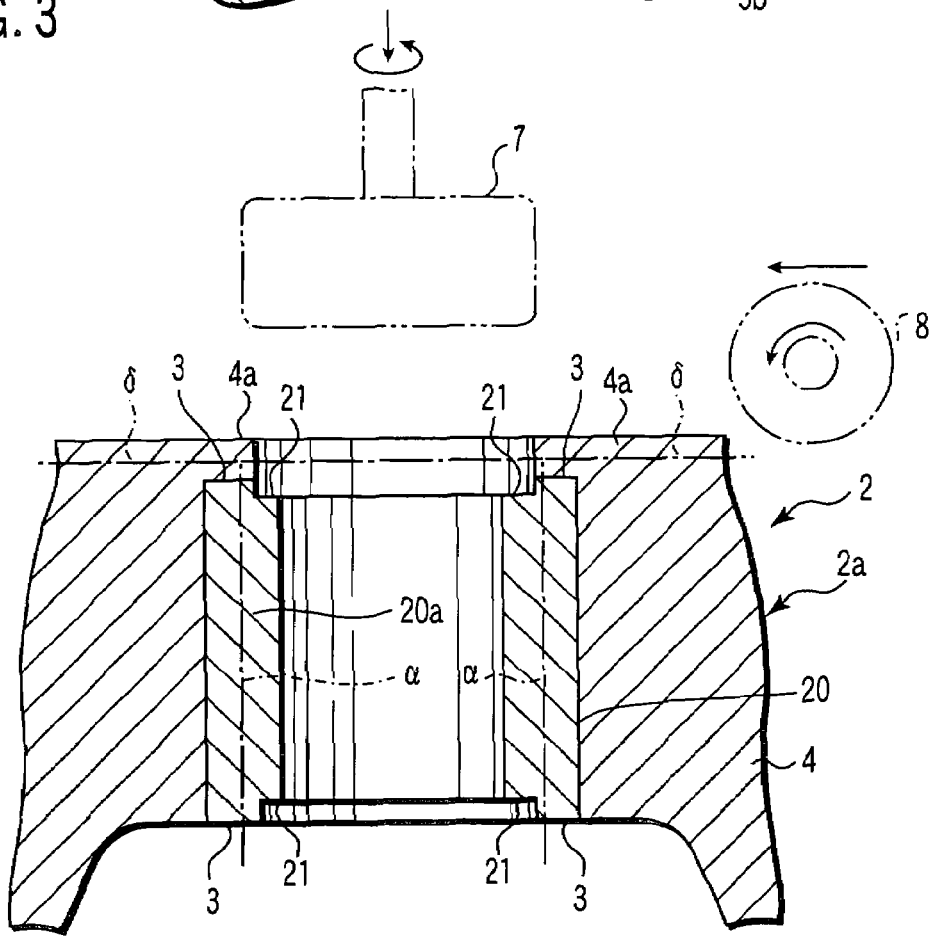
FIG. 4 is a sectional view of the half-finished cylinder block cast by the mold shown in FIG. 3, in the vicinity of the cylinder liner.

In the cylinder block body 2*a* as a half-finished product of the cast cylinder block 2, the outer circumference of the cylinder liner 20 and an extent of the end-face 3 in the deck surface side consisted the tolerance range β and casting area γ are covered by the aluminum alloy 4, as shown in FIG. 4.

Several machining processes are performed to finish the cylinder block body 2*a* to be a completed cylinder block 2, as shown in FIG. 4. To finish the internal circumference of the cylinder liner to a predetermined inside diameter dimension, hole machining such as boring and honing are performed from the deck surface side together with the upper side projected part 4*a* covering the end-face 3, by using a hole machining tool 7 whose machining diameter is previously determined to meet the final finished dimension. The deck surface of the cylinder block body 2*a* is performed a grinding operation to be finished to the position indicated by the line δ in FIG. 4 by using the cutting tool 8.

As a result of the hole machining, when the internal circumference of the cylinder liner 20 is finished within the dimensional tolerance range β considering the machining and finished-product, the internal circumference of the cylinder liner 20 is formed flat. Namely, the liner hole 23, which is continued flat without unevenness from the upper side projected part 4*a* covering the end-face 3 of the cylinder liner 20 to the internal circumference of the cylinder liner 20, is formed.

Figure 5:
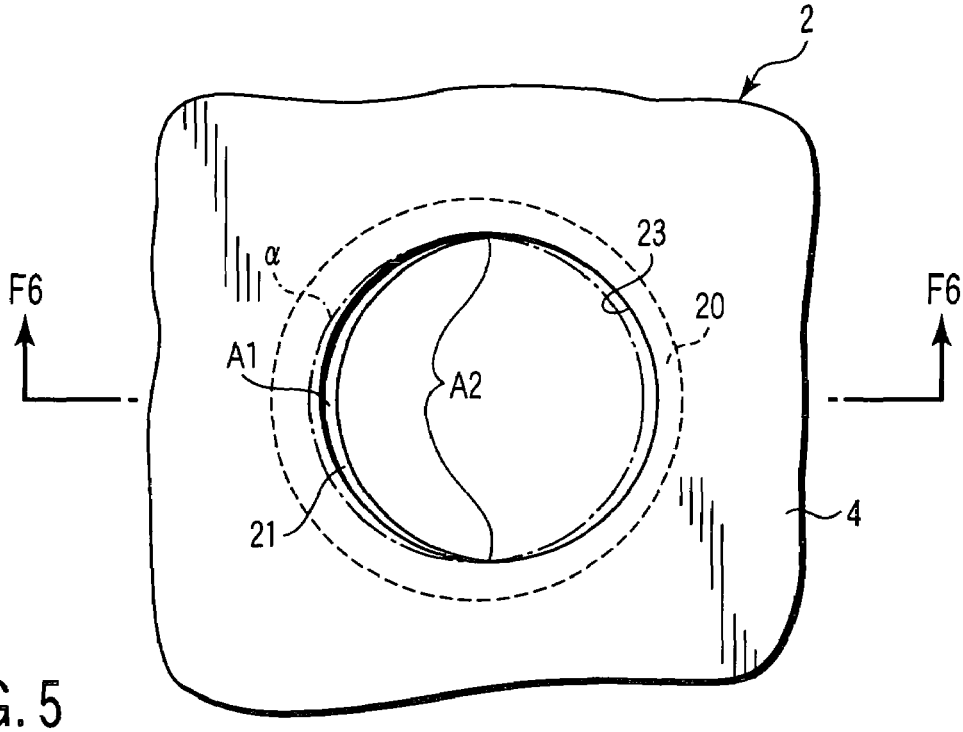
FIG. 5 is a plan view of the cylinder block showing a liner hole that is extremely displaced by machining of a cylinder liner hole in the cylinder block shown in FIG. 4.
Figure 6:
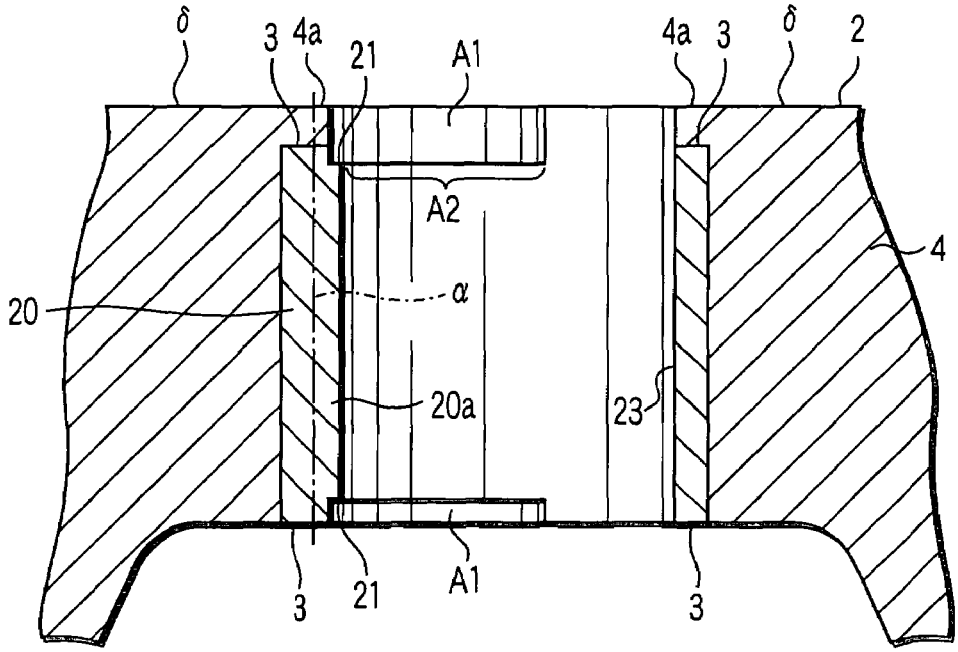
FIG. 6 is a sectional view of the cylinder block taken along lines F6-F6 shown in FIG. 5.

However, the hole machining for the cylinder liner 20 may be performed exceeding the dimensional tolerance range β, or at a position extremely displaced from the finished inside diameter dimension position α. In this case, as shown in FIG. 5 and FIG. 6, the wall surface of the same direction as the displaced machined liner hole 23 is continued flat from the upper projected part 4*a* to the cylinder liner 20, but on the wall surface opposite to the displaced direction, the different level portion 21 remains like a crescent by the amount of the displacement exceeding the lower limit value which is the internal circumference side of the dimensional tolerance range β. When the hole position is out of the dimensional tolerance, the cylinder liner 20 will be machined the hole from the different level portion 21 without touching the hole machining tool in the dimension tolerance range β. Therefore, a part to be machined when the displacement is within the dimension tolerance range, or a part of the different level portion 21 as indicated by A1 in FIG. 6 remains like a crescent in a wide range as indicated by A2 in FIG. 5.

Therefore, after the hole machining, it can be realized that the finally machined hole (liner hole 23) of the cylinder liner 20 has been machined in being extremely displaced by checking (detecting) visually that the different level portion 21 remains on the deck surface side that becomes the outside of the cylinder block 2 after the hole is machined, and by checking whether the machining marks remains on the internal circumference of the cylinder liner 20. As a result, it can be avoided to include the cylinder liner 20 having an extremely thin portion.

Though it has been considered difficult to improve the manufacturing accuracy of a cylinder block that is cast with the cylinder liner described above, it is easily possible to improve the positional accuracy of the hole of the cast cylinder liner by applying the present invention. Namely, the quality of cylinder block can be improved. Further, it is possible to detect displacement with a high accuracy in the simple structure with the annular different level portion 21 formed in the end-face 3 of the cylinder liner 20. Displacement can be easily detected by checking visually whether the different level 21 remains after machining the internal circumference of the cylinder liner 20.

The different level portion 21 is formed in both end-faces 3 of the cylinder liner 20. Therefore, when a primary product cylinder liner is set in a mold to cast the cylinder block 2, it can be easily set in the mold irrespectively of the direction of the primary product cylinder liner, and the different level portion 21 is arranged in the deck surface side.

According to the embodiment of the present invention explained as above, the boundary 21*a* of the different level portion 21 taking the finished inside diameter dimension position α of the cylinder liner 20 as a reference is provided at the end portion of the cylinder liner 20 before being cast. Therefore, it is possible to detect extreme displacement of the hole of the cylinder liner 20 by checking whether the different level portion 21 remains after machining the internal circumference of the cylinder liner 20. It is possible to detect displacement of the hole of the cylinder liner 20 with ease without greatly changing the manufacturing method.

According to the cylinder liner 20 of the embodiment of the present invention, it is possible to detect extreme displacement of the hole of the cylinder liner 20 in the simple structure with the different level portion 21 provided at the end portion. According to the embodiment of the present invention with the different level portion 21 provided at both ends of the cylinder liner 20 before being cast, when the cylinder liner 20 is set in the molds 5*a* and 5*b* for casting the cylinder block 2, it is unnecessary to specify the setting direction of the cylinder liner 20. Therefore, the setting operation of the cylinder liner 20 in the molds 5*a* and 5*b* is lightened, improving the working efficiency.

A second embodiment of the present invention will be described with reference to FIGS. 7-10. The components that have the same functions as those in the first embodiment will respectively applying the same reference symbols, and detailed explanation will be omitted.

Figure 8:
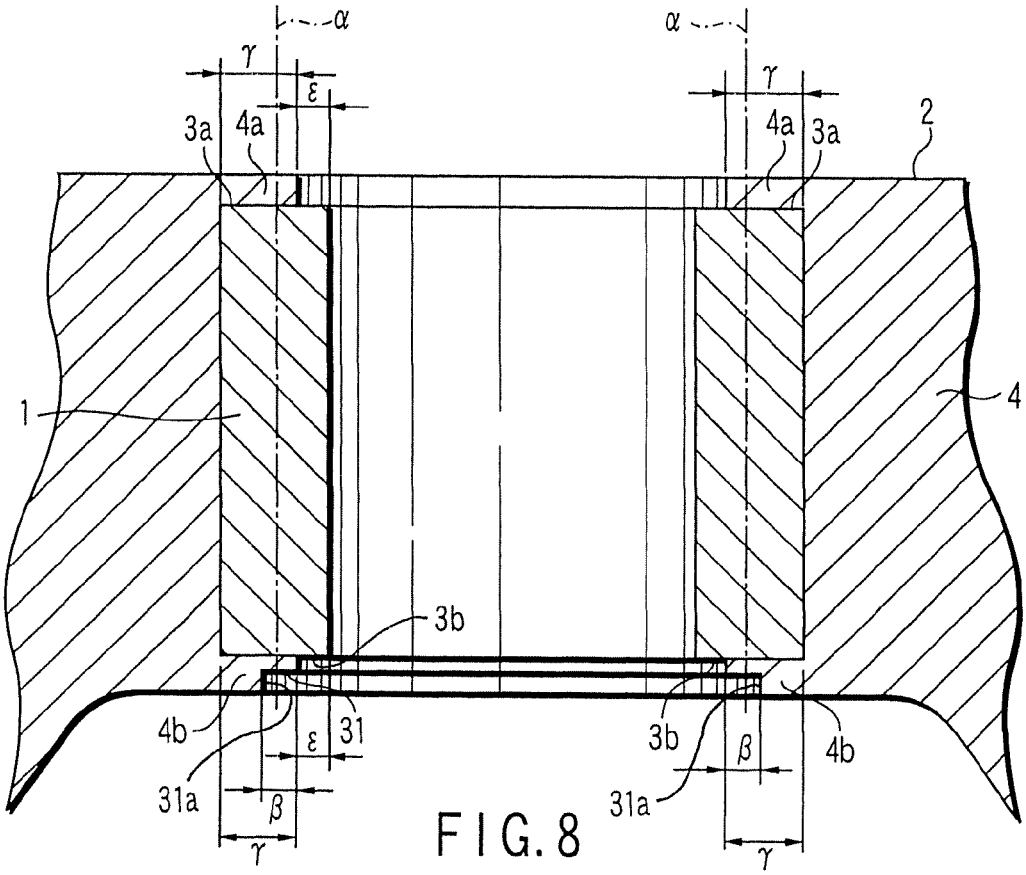
FIG. 8 is a sectional view of the cylinder block taken along lines F8-F8 shown in FIG. 7.

A cylinder block 2 of this embodiment has an upper side projected part 4*a* formed along the upper end-face 3*a* of a cylinder liner 1, and a lower side projected part 4*b* formed along the lower end-face 3*b*, as shown in FIG. 8. The upper projected part 4*a* projects to the inside of the internal circumference edge of the dimensional tolerance range β provided with respect to the finished inside diameter dimension position α, and covers the casting area γ. Likewise, the lower side projected part 4*b* projects inside from the internal circumference edge of the dimensional tolerance range β and covers the casting area γ.

Figure 7:
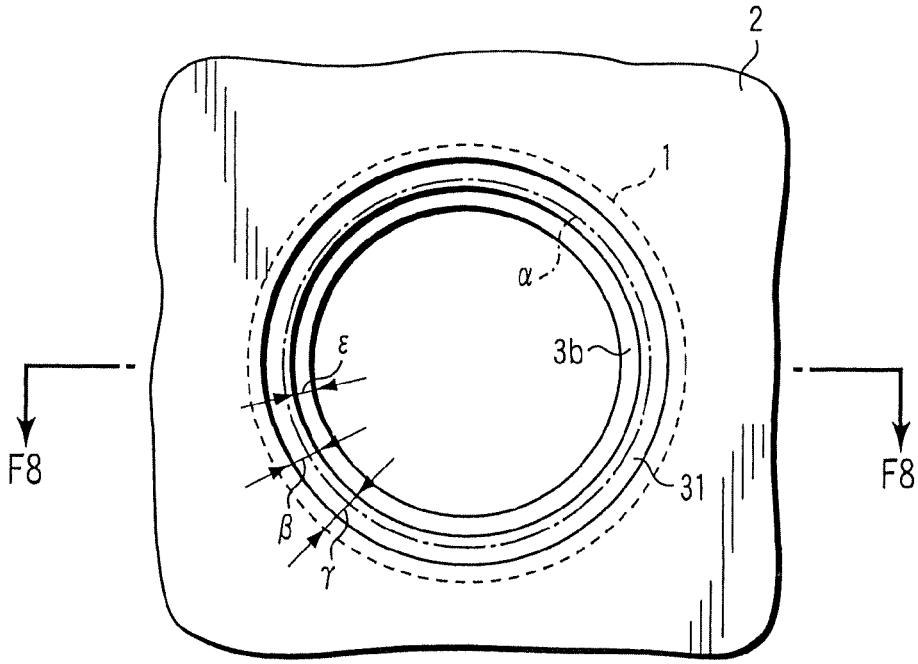
FIG. 7 is a plan view of a cylinder block according to a second embodiment of the present invention, as seen from below in the state before a cylinder liner hole is machined.

The lower side projected part 4*b* has further a different level portion 31 corresponding to the width of the dimensional tolerance range β. The boundary 31*a* of the different level portion 31 is provided at the position of the outside edge that becomes the outside diameter of the dimension tolerance range β that is provided in the outer circumference side farther than the finished inside diameter dimension position α. Therefore, as shown in FIG. 7, the finished inside diameter dimension position α is provided within the range of the different level portion 31. The upper side projected part 4*a* is formed by casting by the cavity part 12*a* formed between the upper end-face 3*a* of the cylinder liner 1 and the upper mold 5*a* for die-casting the cylinder block. The lower projected part 4*b* is formed by casting by the cavity part 12*b* formed between the lower end-face 3*b* of the cylinder liner 1 and the lower mold 5*b* for die-casting.

The upper mold 5*a* has a shaft-shaped part 10 and a holding part 14. The shaft-shaped part 10 is inserted into the cylinder liner 1, and the lower end comes into contact with the lower mold 5*b*. The holding part 14 is provided at the base of the shaft-shaped part 10, and comes into contact with the upper end-face 3*a* of the cylinder liner 1 in the range inside of the casting area γ provided in the upper end-face 3*a* of the cylinder liner 1. The lower mold 5*b* has a holding part 11 and a step-forming part 15. The holding part 11 comes into contact with the lower end-face 3*b* of the cylinder liner 1 in the range of the inside diameter from the inside edge of the dimensional tolerance range β. The step-forming part 15 is provided annularly on the outer circumference of the holding part 11, and has the width corresponding to the dimensional tolerance range β.

Figure 9:
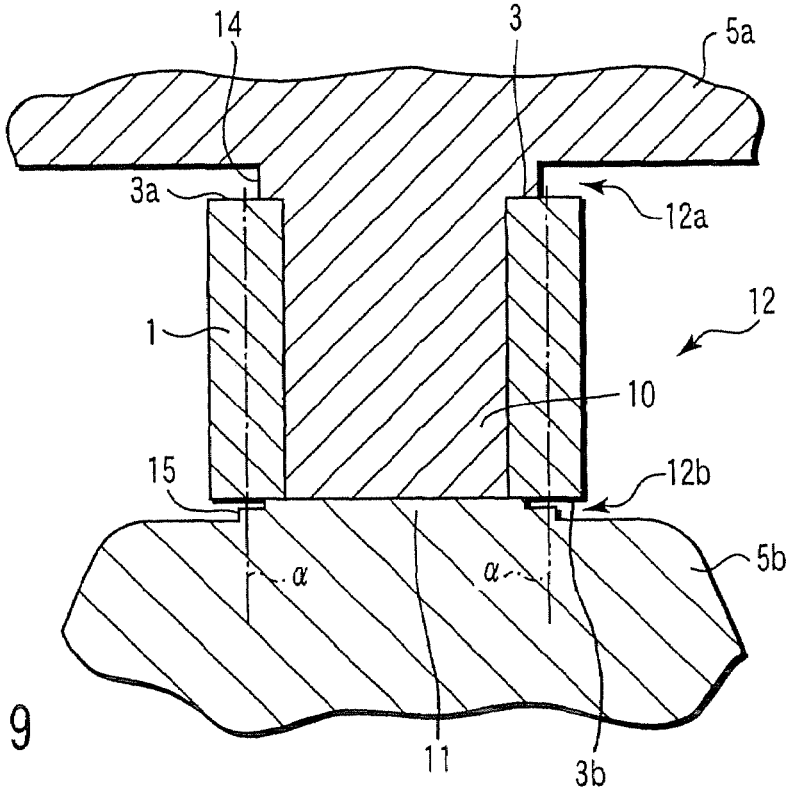
FIG. 9 is a sectional view of the state in which the cylinder liner is held in a mold to cast the cylinder block shown in FIG. 8.
Figure 10:
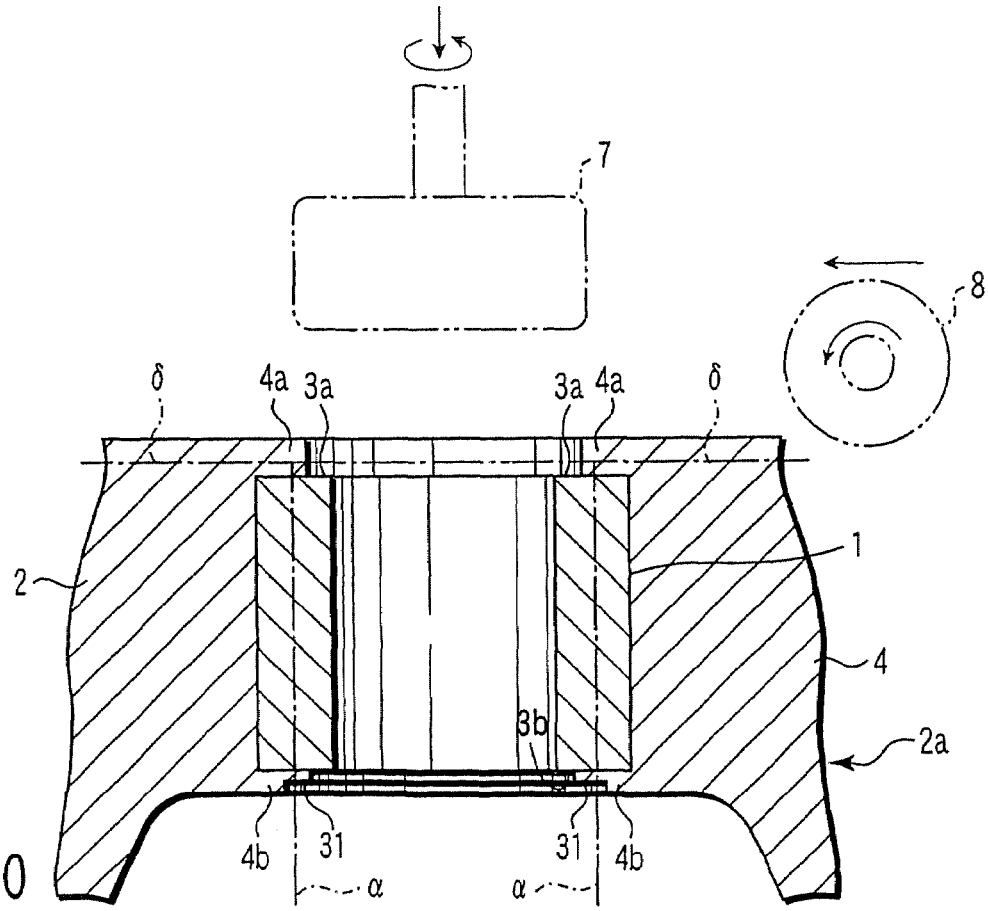
FIG. 10 is a sectional view of the half-finished cylinder block cast by the mold shown in FIG. 9, in the vicinity of the cylinder liner.
Figure 11:
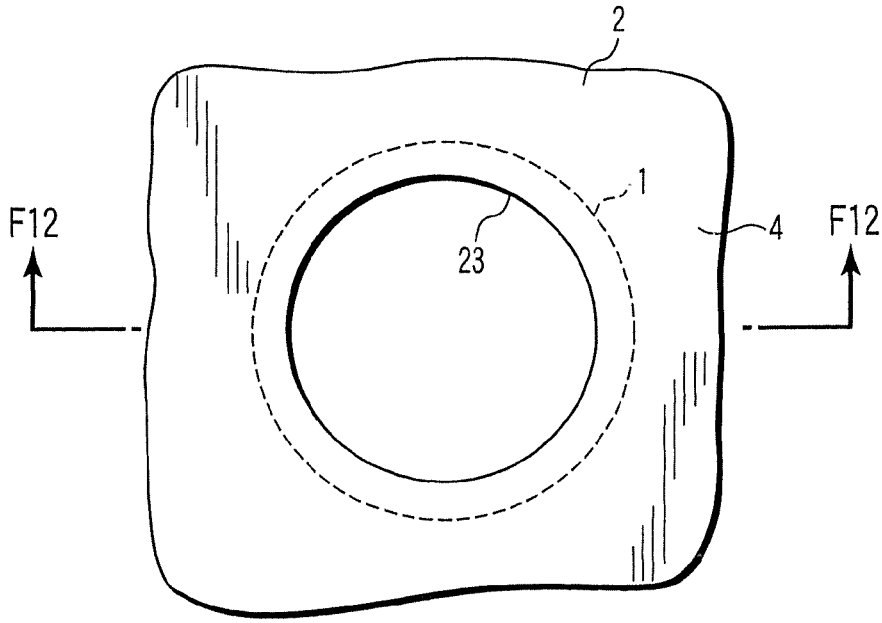
FIG. 11 PRIOR ART
FIG. 11 is a plan view of a conventional overcasting-type cylinder block.
Figure 12:
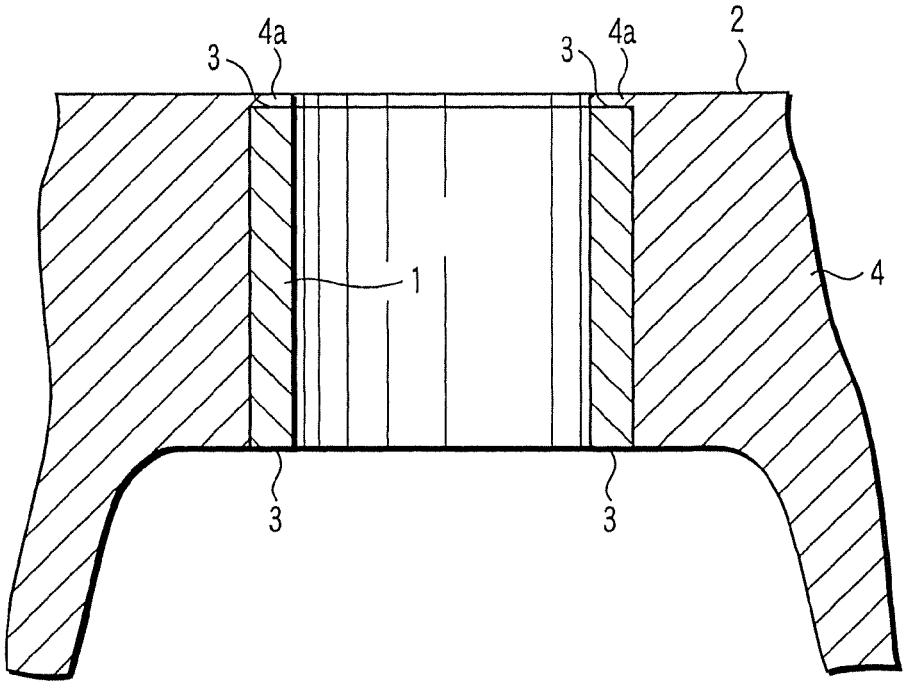
FIG. 12 PRIOR ART
FIG. 12 is a sectional view of the cylinder block taken along lines F12-F12 shown in FIG. 11.
Figure 13:
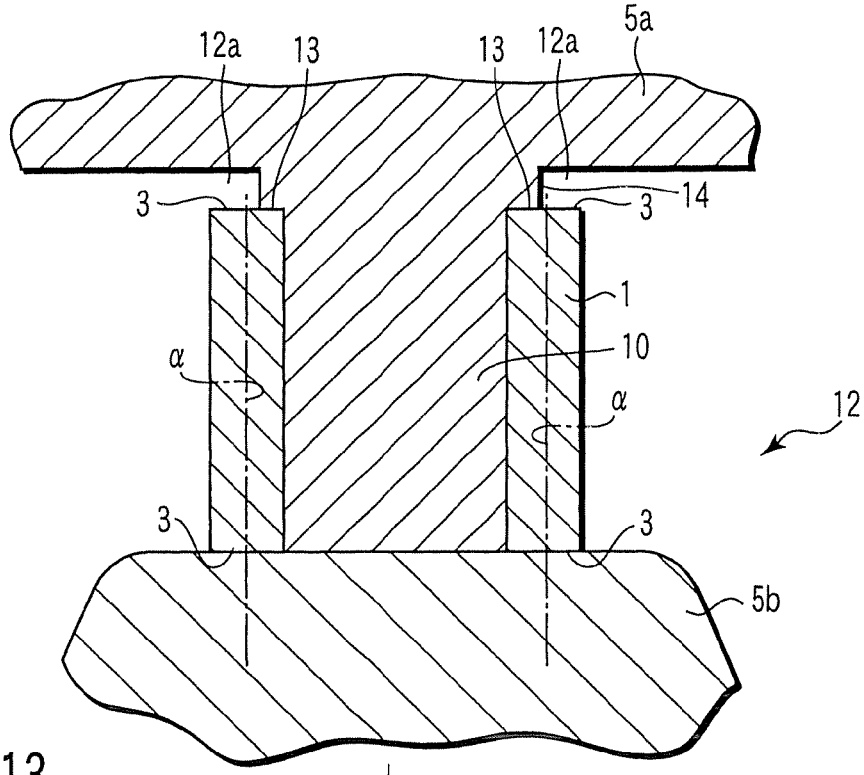
FIG. 13 PRIOR ART
FIG. 13 is a sectional view of the cylinder liner set in the mold to cast the cylinder block shown in FIG. 12.
Figure 14:
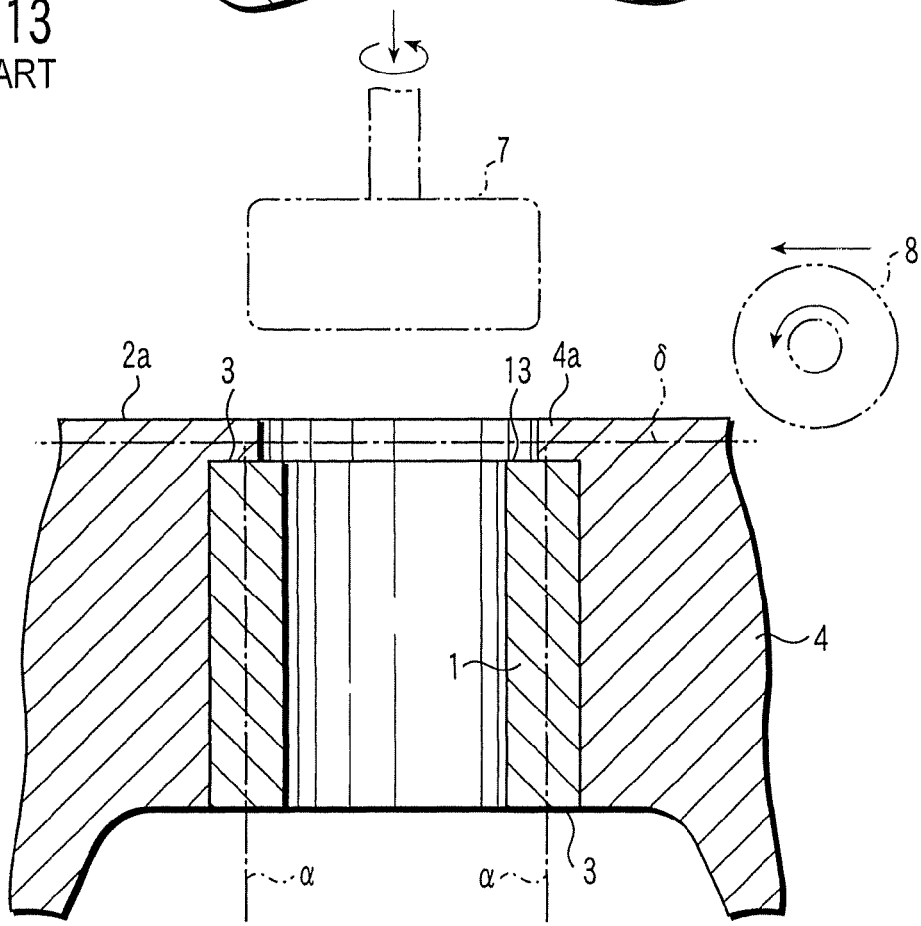
FIG. 14 PRIOR ART
FIG. 14 is a sectional view of the half-finished cylinder block cast by the mold shown in FIG. 13, in the vicinity of the cylinder liner.

The cylinder block 2 is cast with the cylinder liner 1 in the following procedure. First, the cylindrical primary product cylinder liner 1 is held between the upper mold 5*a* and lower mold 5*b* for die-casting, as shown in FIG. 9. In this state, cast the cylinder block 2 by filling molten metal of aluminum alloy into a cavity 12 formed by the upper mold 5*a* and lower mold 5*b* and the outer circumference of the cylinder liner. As a result, the cylinder block having a different level portion 31 in the lower side projected part 4*b* is formed in the state shown in FIG. 10. Thereafter, as in the first embodiment, the deck surface and the internal circumference of the cylinder liner 1 are machined for finishing. If the inside diameter of hole of the cylinder liner 1 is within the dimensional tolerance range β with respect to the finished inside diameter dimension position α that is a target position, the different level portion 31 remains allover the circumference. Therefore, by confirming that the different level portion 31 remains after the machining, it is realized that the hole position of the cylinder liner 1 has been correctly machined. As the cylinder block 2 has a lower side projected part 4*b* along the lower end-face 3*b* of the cylinder liner 1, compared with the case not having the lower extended portion 4*b*, a less burr is generated after machining the internal circumference of the cylinder liner 1, and the operation of eliminating the burr can be lightened.

While the different level portion 21 is provided in the cylinder liner 20 in the first embodiment, the different level portion 31 is provided in the cylinder block 2 in the second embodiment. While the different level portion 21 is eliminated by machining the internal circumference of the cylinder liner 20 in the first embodiment, the different level portion 31 remains after machining the internal circumference of the cylinder liner 1 in the second embodiment. Therefore, it can be easily confirmed by visual inspection after the hole of the cylinder liner 1 is machined that the hole of the cylinder liner 1 of the cylinder block 2 of the second embodiment has been machined at the position nearer to the finished inside diameter dimension position α.

The present invention is not limited to the embodiments described above. The invention may be modified in the scope without departing from the its spirit or essential characteristics.

The technique according to the present invention can be applied not only to a cylinder block in which a cylinder liner is cast. It can also be applied as a technique to cast a bearing liner in a housing in a slide bearing.

What is claimed is:

1. A method of manufacturing a cylinder block by casting a cylindrical cylinder liner at a predetermined position, the cylinder liner having an outer wall and an inner wall comprising:

preparing a cylinder liner as a primary product having an end wall and an annular different level portion axially inward of the end wall with a boundary formed inward in the radial direction by a predetermined dimension with respect to a finished dimension of an internal circumference of the inner wall of the cylinder liner;

fixing the cylinder liner as a primary product to a holding part that is provided in a mold to form the cylinder block, the mold having a portion fitting with the different level portion;

casting the cylinder block by filling the mold with molten metal;

machining the inner wall of the cylinder liner to the finished dimension; and detecting whether the different level portion still exists after the machining step to determine at least one of a position of the cylinder liner relative to the cylinder block, a position of the inner wall of the cylinder liner relative to the outer wall of the cylinder liner, and a thickness of the cylinder liner between the cylinder liner inner wall and the cylinder liner outer wall.

2. A method of manufacturing a cylinder block comprising:

providing a cylinder liner having an inner wall and an outer wall and an annular end face having an radially inner annular portion and a radially outer annular portion;

providing a cylinder block mold including a holding portion for holding the cylinder liner during a casting process;

placing the cylinder liner in the mold on the holding portion so that the holding portion engages the radially inner portion of the annular end face of the cylinder liner;

filling the mold with molten metal so that the metal fills a space between the radially outer annular portion of the cylinder liner and the holding portion to form a different level portion in the cylinder block at the end face of the cylinder liner;

finish machining the inner wall of the cylinder liner after casting to remove at least part of the different level portion; and detecting whether portions of the different level portion still exist after the finish machining step to determine at least one of a displacement of the cylinder liner from the cylinder block, a displacement of the machining position of the inner wall of the cylinder liner relative to the outer wall of the cylinder liner, and a thickness of the cylinder liner between the inner wall and the outer wall.

* * * * *